US006724276B2

(12) United States Patent
Kawanami et al.

(10) Patent No.: US 6,724,276 B2
(45) Date of Patent: Apr. 20, 2004

(54) NON-RECIPROCAL CIRCUIT DEVICE AND COMMUNICATION APPARATUS

(75) Inventors: Takashi Kawanami, Ishikawa-ken (JP); Takashi Hasegawa, Kanazawa (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 10/152,621

(22) Filed: May 23, 2002

(65) Prior Publication Data

US 2002/0196092 A1 Dec. 26, 2002

(30) Foreign Application Priority Data

Jun. 22, 2001 (JP) ..... 2001-190432

(51) Int. Cl.[7] ..... H01P 1/32
(52) U.S. Cl. ..... 333/1.1; 333/24.2
(58) Field of Search ..... 333/1.1, 24.2

(56) References Cited

U.S. PATENT DOCUMENTS 5,223,805 A * 6/1993 Talcott et al. ..... 333/1.1
5,620,543 A * 4/1997 Marusawa et al. ..... 156/89.12
5,945,887 A * 8/1999 Makino et al. ..... 333/1.1
6,462,628 B2 * 10/2002 Kondo et al. ..... 333/24.2
6,512,424 B2 * 1/2003 Furuya et al. ..... 333/1.1

FOREIGN PATENT DOCUMENTS

JP 11-195912 7/1999

* cited by examiner

*Primary Examiner*—Michael Tokar
*Assistant Examiner*—Linh Van Nguyen
(74) *Attorney, Agent, or Firm*—Keating & Bennett, LLP

(57) ABSTRACT

A non-reciprocal circuit device includes a lower metal case, a terminal resin case, a central-electrode assembly, an upper metal case, and a permanent magnet. The central-electrode assembly includes a ferrite to which a dc magnetic field is applied by the permanent magnet, and central electrodes disposed around the ferrite. The terminal resin case includes two sets of opposing side walls and a bottom wall, and cut surfaces formed when a lead frame is separated are provided in one set of side walls, respectively. Terminals for surface mounting are provided on another set of side walls which is different from the one set of side walls.

16 Claims, 10 Drawing Sheets

NON-RECIPROCAL CIRCUIT DEVICE AND COMMUNICATION APPARATUS

BACKGROUND OF THE INVENTION

1. Field of the Invention

The present invention relates to a non-reciprocal circuit device, such as an isolator, a circulator, or other suitable device, used in a microwave band and a communication apparatus including such a non-reciprocal circuit device.

2. Description of the Related Art

An example of a known lumped-constant-type isolator used in mobile communication apparatuses such as portable telephones, and other suitable communication apparatuses, is described in Japanese Unexamined Patent Application Publication No. 11-195912. As shown in FIG. 12, the isolator 200 includes a terminal resin case 202, a lower metal case 208, and an upper metal case 204, and a permanent magnet and a central-electrode assembly provided in the terminal resin case, although not shown.

In FIG. 12, an input-output terminal 210 and a ground terminal 211 for surface mounting are provided on a side wall 202*a* on the front surface of the terminal resin case 202. An input-output terminal and a ground terminal are also provided on a side wall 202*a* on the rear surface of the terminal resin case 202, although not shown.

As shown in FIG. 12, the isolator 200 is produced using a lead frame 231 in order to facilitate handling of the product in production and automation of the production. The lead frame 231 is successively transported from one assembling process step to another via pilot holes 234 provided in each of a pair of hoop portions 233. While the lead frame 231 is transported from one assembling process step to another, the ground terminal 211 and the input-output terminal 210 are insert-molded in the terminal resin case 202. A connection portion 235 is provided on the bottom portion (side of the substrate for mounting the isolator 200) of the side wall 202*a* of the terminal resin case 202 to facilitate mounting of components in later steps. Then, the components (upper metal case 204 and lower metal case 208) of the isolator 200 are mounted, and the isolator 200 is assembled. The isolator 200 is separated from the lead frame 231 by stamping out the connection portion 235, which connects the lead frame 231 with the isolator 200 and by using a cutting die.

However, as shown in FIG. 12, since the isolator 200 is separated from the lead frame 231 by stamping out the connection portion 235 provided on the side wall 202*a* of the terminal resin case 202, burrs are produced on the cutting surface of the connection portion 235. When these burrs are present, mounting conditions of the isolator 200 deteriorate because a gap caused by the burrs exists between the isolator 200 and the mounting substrate. For example, the mounting anchorage of the isolator deteriorates, and the terminals 210 and 211 are separated from the connection electrodes of the mounting substrate, which produces an open circuit.

Furthermore, since the terminals 210, 211 and the connection portion 235 are provided on the side wall 202*a* of the terminal resin case 202, the width of the input-output terminal 210 and the grounding terminal 211 is reduced because the connection portion 235 is provided on the side wall 202*a*, and the solder joint area of the mounting substrate and the input-output terminal 210 and grounding terminal 211 is reduced. Therefore, when the isolator 200 is mounted on a mounting substrate, the mounting anchorage of the input-output terminal 210 and grounding terminal 211 deteriorates.

SUMMARY OF THE INVENTION

In order to overcome the problems described above, preferred embodiments of the present invention provide a non-reciprocal circuit device which provides greatly improved mounting anchorage, reduced size, and outstanding reliability, and a communication apparatus including the non-reciprocal circuit device.

According to a preferred embodiment of the present invention, a non-reciprocal circuit device includes a permanent magnet, a ferrite member having a DC magnetic field provided by the permanent magnet and a central electrode assembly including a plurality of central electrodes arranged around the ferrite, a terminal resin case including the center electrode assembly, the terminal resin case having a first side surface defining a cutting surface when the terminal resin case is separated from a lead, input-output and ground terminals which are led out from a second side surface, different from the first side surface of the terminal resin case, and a metal case which includes the permanent magnet and the terminal resin case.

Accordingly, since the cutting surface, formed when separated from the lead frame, is provided on the first side surface of the terminal resin case and the input-output and grounding terminals are provided on the second side surface, which is different from the first side surface, of the terminal resin case, the width of the input-output and grounding terminals is greatly increased and the solder joint area of the substrate for mounting and each of the terminals is greatly increased.

Furthermore, preferably, a grounding electrode plate that is separated from the lead frame at the cut surface is integrally provided with the terminal resin case, and the grounding electrode plate extends to define the ground terminal. In this way, the ground potential of the grounding electrode plate integrally provided together with the ground terminal is reduced, and stray inductance which does not contribute to the operation of a non-reciprocal circuit device is minimized.

Furthermore, preferably, a concave portion is provided on the side surface of the terminal resin case, the cut surface is disposed in the concave portion, and the cut surface is covered by the metal case. In this way, when the non-reciprocal circuit device is separated from the lead frame, the positional accuracy for separation is less important. That is, even if the position for separation deviates slightly, the left portion is received in the concave portion and will not protrude outside of the dimensions of the non-reciprocal circuit device. Furthermore, even if burrs and metal chippings exist on the cut surface, the cut surface is still covered by the metal case, and thus, a short circuit and an open circuit are not caused.

Furthermore, preferably, an insertion hole is provided in the grounding electrode plate so as to insert the central-electrode assembly. That is, since a portion of the central-electrode assembly is included in the grounding electrode plate, the height of the non-reciprocal circuit device is reduced by the thickness of the grounding electrode plate.

Furthermore, since a communication apparatus according to the present invention includes a non-reciprocal circuit device according to preferred embodiments described above, a smaller, a less expensive and more reliable apparatus is provided.

Other feature, elements, characteristics and advantages of the present invention will become more apparent from the following detailed description of preferred embodiments of the present invention with reference to the attached drawings.

DETAILED DESCRIPTION OF PREFERRED EMBODIMENTS

Hereinafter, preferred embodiments of a non-reciprocal circuit device and a communication apparatus according to the present invention are described with reference to the accompanying drawings. Moreover, in each preferred embodiment of the present invention, a lumped-constant-type isolator is described as an example, however, the description can be applied to non-reciprocal circuit devices including circulators and couplers, and other suitable devices.

Figure 1:
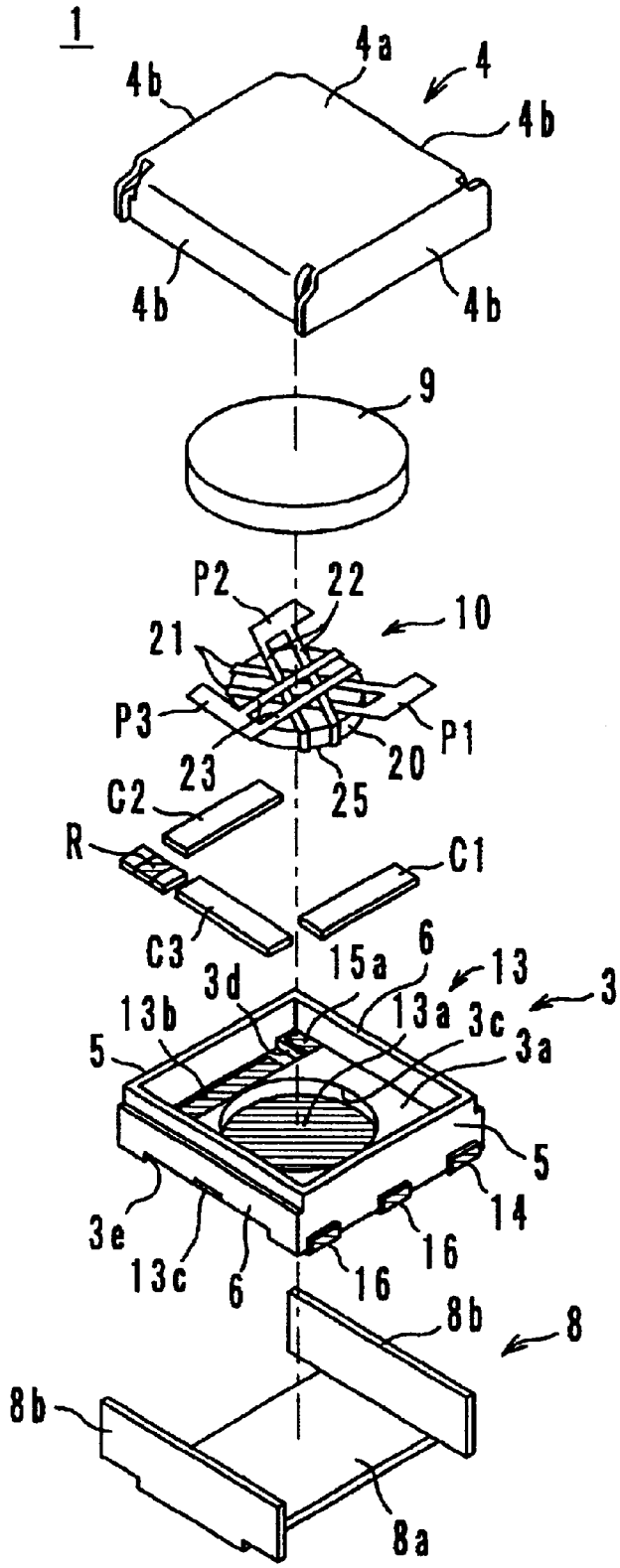
FIG. 1 is an exploded perspective view showing a first preferred embodiment of a non-reciprocal circuit device according to the present invention.

FIG. 1 is an exploded perspective view of a preferred embodiment of a non-reciprocal circuit device according to the present invention. As shown in FIG. 1, a lumped-constant-type isolator 1 includes a lower metal case 8, a terminal resin case 3, a central-electrode assembly 10, an upper metal case 4, a permanent magnet 9, a resistance element R, and matching capacitance elements C1 to C3.

The upper metal case 4 is preferably substantially rectangular in top view and has a top wall 4*a* and four sidewalls 4*b*. The lower metal case 8 has a bottom wall 8*a* and left and right sidewalls 8*b*. The upper metal case 4 and lower metal case 8 are formed by stamping out a thin plate made of a material including iron as a major constituent, bending the stamped out thin metal plate, and then coating the thin plate with copper plating and silver plating.

In the central-electrode assembly 10, central electrodes 21 to 23 are provided on the upper surface of a disc-like microwave ferrite member 20, with an insulation sheet (not shown) provided between the assembly 10 and the upper surface of the microwave ferrite 20, such that the central electrodes 21 to 23 cross one another at an angle of approximately 120 degrees.

Each of the central electrodes 21 to 23 includes port portions P1 to P3 on the side of one end of the electrodes and a grounding electrode 25 is connected to the side of the other end. The common ground electrode 25 of the central electrodes 21 to 23 is provided so as to substantially cover the entire lower surface of the ferrite member 20 (see FIG. 3).

The terminal resin case 3 is configured such that an input terminal 14 for surface mounting, an output terminal 15 for surface mounting, and a grounding terminal 16 for surface mounting are insert-molded into the terminal resin case 3. The terminal resin case 3 includes a bottom wall 3*a* and two sets of opposing sidewalls 5 and 6. A substantially round insertion hole 3*c* is provided in the approximate middle of the bottom wall 3*a*, and a substantially rectangular window portion 3*d* for housing the matching capacitance elements C1 to C3 and the resistance element R is provided around the insertion hole 3*c*. Furthermore, a notch portion 3*e*, in which the bottom wall 8*a* of the lower metal case 8 is disposed, is provided on the lower side of the bottom wall 3*a* of the terminal resin case 3 (see FIG. 3). Furthermore, as described later, cut surfaces 13*c*, which are formed by cutting support portions 33 extending from each of a pair of hoop portions 31 of a lead frame 30, are disposed on the outside surface (first side surface) of the side walls 6 of the terminal resin case 3.

The terminal resin case 3 is preferably made of a liquid crystal polymer, polyphenylene sulfide, polyether ether ketone or other suitable material. The liquid crystal polymer, polyphenylene sulfide, and polyether ether ketone have heat resistance suitable for the isolator 1 and are low-loss materials in a microwave band (UHF to SHF bands).

Figure 5:
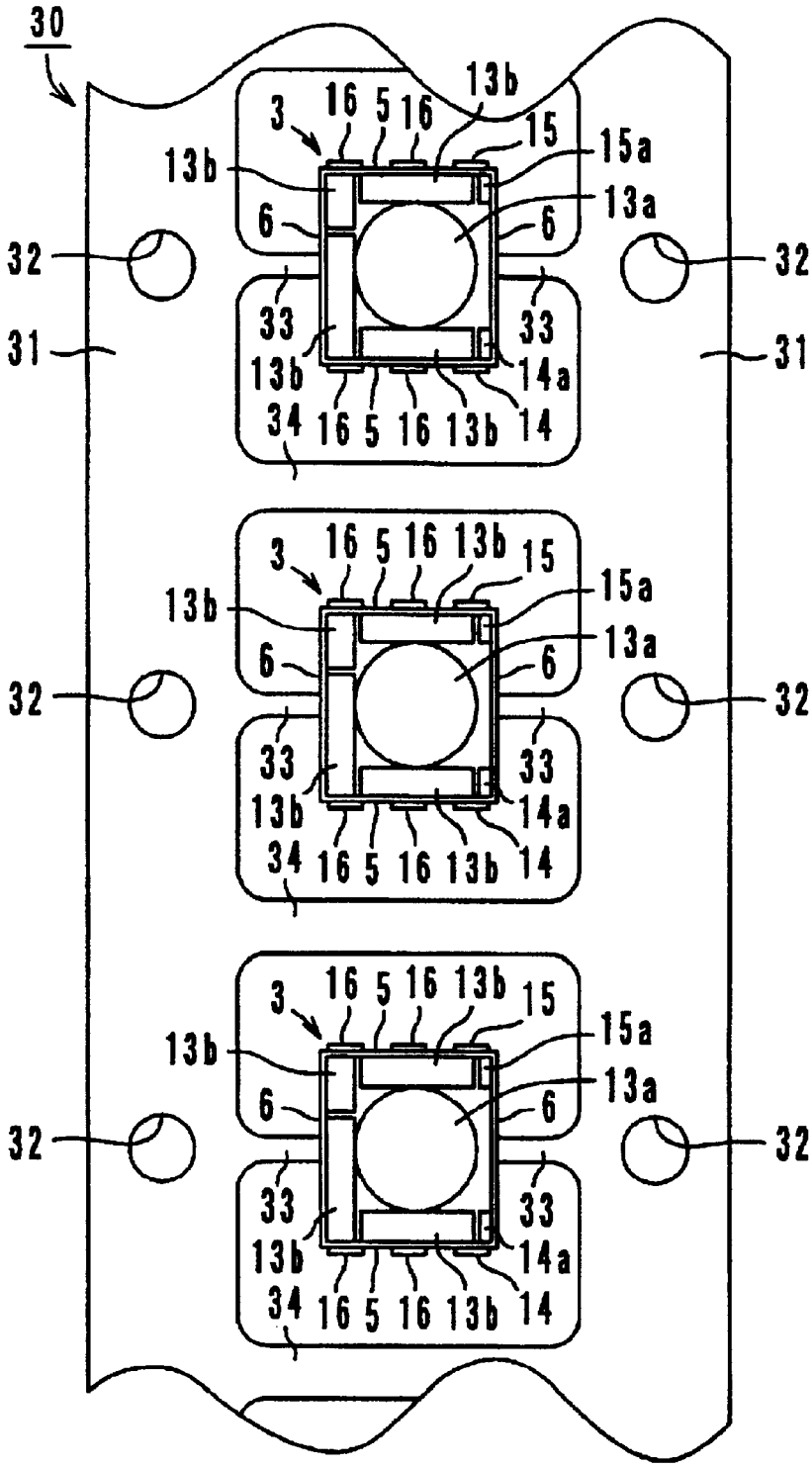
FIG. 5 is a top view showing a grounding electrode plate that is insert molded into a terminal resin case, which is to describe a manufacturing method of the terminal resin case shown in FIG. 1.

One end of the input terminal 14 for surface mounting is exposed on the outer surface (second side surface) of the side wall 5, and the other end is exposed on the inner surface of the bottom wall 3*a* so as to define an input lead-out electrode 14*a* (see FIG. 5). One end of the output terminal 15 for surface mounting is exposed on the outer surface (second side surface) of the side wall 5, and the other end is exposed on the inner surface of the bottom wall 3*a* to define an output lead-out electrode 15*a*.

The grounding electrode plate 13 is integrally insert-molded in the bottom wall 3*a* of the terminal resin case 3. The grounding electrode plate 13 includes the surface-mounting grounding terminals 16, two of which are led out through each of a pair of sidewalls 5 (see FIG. 5). Since the grounding electrode plate 13 is integral together with the surface-mounting grounding terminals 16, the grounding electric potential of the grounding electrode plate 13 is reduced. Accordingly, stray capacitance which does not contribute to the operation of the isolator 1 is minimized, and the bandwidth the high-frequency characteristics of the isolator 1 is increased. Furthermore, the grounding electrode plate 13 is defined by a grounding electrode 13*a* which is exposed through the insertion hole 3*c* and a grounding electrode 13*b* which is exposed through the substantially rectangular window portion 3*d*. The grounding electrode plate 13, the surface-mounting terminal 14, the surface-mounting output terminal 15, and the surface-mounting grounding terminals 16 are made of, for example, a base material including a magnetic metal containing iron, brass, and phosphor bronze as major components, and is covered by a metal film having outstanding solderability. When a magnetic metal such as iron, is used, the magnetic reluctance of a magnetic circuit is reduced. Accordingly, since the thickness of the permanent magnet 9 and the lower metal case 8 is decreased, the height of the isolator 1 is reduced. Particularly, nickel plating and copper plating (typical plating thickness: about 0.1 μm to about 1 μm) are provided on the base material. The silver plating (typical plating thickness: about 1 μm to about 10 μm) has high electrical conductivity, the silver plating reduces the insertion loss of the isolator 1, and the silver plating also prevents corrosion and improves solderability. Furthermore, the nickel plating and copper plating improve anchorage of the silver plating to the base material. Since a high-frequency current on which the isolator 1 functions is concentrated on the surface portion of the terminals 14 to 16, the film thickness of the silver plating is determined based on the skin depth at the center frequency of the passband because of the conductor skin effect. In the first preferred embodiment, the film thickness of copper base plating is preferably about 1 μm, and the film thickness of silver plating is preferably about 3 μm. Since the same material is preferably used for the grounding electrode plate 13 and terminals 14 to 16, the grounding electrode plate 12 and the terminals 14 to 16 can be mass-produced from one flat plate at a reduced cost by presswork.

In the matching capacitance elements C1 to C3, the hot-side capacitance electrode 27 is provided on the entire upper surface, and the cold-side capacitance electrode 27 is provided on the entire lower surface.

In the resistance element R, the grounding-side terminal electrode and the hot-side terminal electrode are provided on both end portions of an insulation substrate by thick-film printing, or other suitable method, and a resistor is provided between the electrodes.

The above-described components are assembled as described below. The bottom wall 8*a* of the lower metal case 8 and the notch portion 3*e* of the terminal resin case 3 are put together, and the lower metal case 8 and the grounding electrode plate 13 are joined by soldering (see FIG. 3).

Then, the matching capacitance elements C1 to C3 and the resistance element R are provided in the window portion 3*d* of the terminal resin case 3, and the central-electrode assembly 10 is provided in the insertion hole 3*c* of the terminal resin case 3. The grounding electrode 25 provided on the bottom surface of the ferrite 20 is inserted through the insertion hole 3*c* provided in the bottom wall 3*a* of the terminal resin case 3, connected to the grounding electrode plate 13*a* of the grounding electrode plate 13, and grounded.

At this time, the hot-side terminal electrode of the resistance element R is connected to the hot-side capacitance electrode 27 of the matching capacitance element C3 through the port portion P3 defined by the terminal portion of the central electrode 23, and the grounding-side terminal electrode of the resistance element R is connected to the grounding electrode 13*b* of the grounding electrode plate 13 exposed at the window portion 3*d* of the terminal resin case 3. The hot-side capacitance electrodes 27 of the matching capacitance elements C1 to C3 are connected to the port portions P1 to P3, respectively. The cold-side capacitance electrodes 27 are connected to the grounding electrode 13*b* of the grounding electrode plate 13, respectively. That is, since the grounding electrodes 13*b* are electrically connected to the surface-mounting grounding terminal 16, the matching capacitance element C3 and the resistance element R are electrically connected in parallel between the port portion P3 of the central electrode 23 and the surface-mounting grounding terminal 16 (see FIG. 4). Further, the connections of the capacitance electrodes 27 and grounding electrode 25 to the grounding electrodes 13*a* and 13*b* are performed by a method of reflowing of solder, or other suitable method.

Then, the upper metal case 4 is fitted from above. The permanent magnet 9 is disposed under the upper wall 4*a* of the upper metal case 4. A DC magnetic field is applied to the ferrite 20 of the central-electrode assembly 10 by the permanent magnet 9. The side wall 8*b* of the lower metal case 8 and the side wall 4*b* of the upper metal case 4 are electrically connected by a method of reflowing of solder, or other suitable method, to form a metal case defining a magnetic circuit and to function as a yoke. Furthermore, since the lower metal case 8 is joined to the grounding electrode plate 13 via solder on a wide area thereof, the ground potential of the cases 4 and 8 greatly reduced and leakage of a high-frequency electromagnetic field which has adverse effect on other electronic components (for example, other electronic elements of a communication apparatus on which the isolator 1 is mounted) is prevented.

Figure 2:
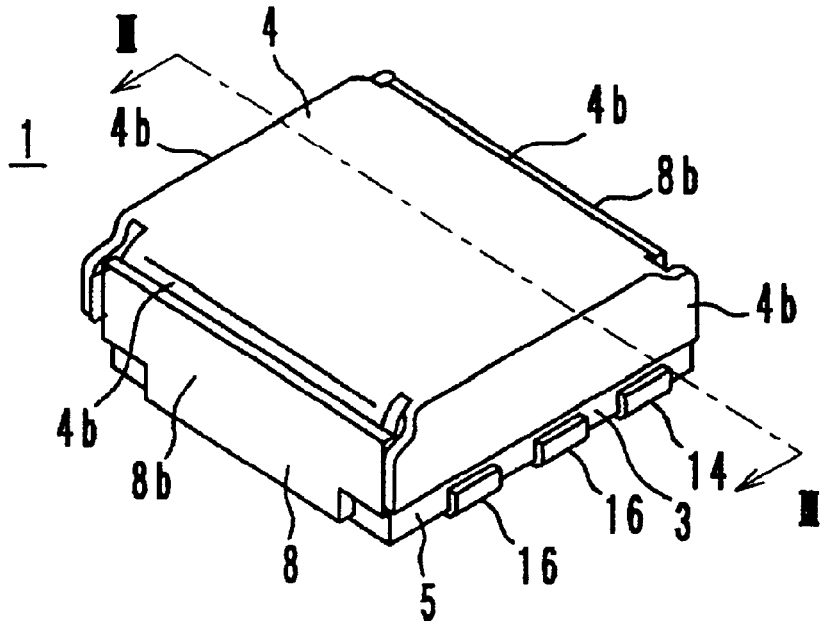
FIG. 2 is a perspective view when the non-reciprocal circuit device in FIG. 1 has been assembled.
Figure 3:
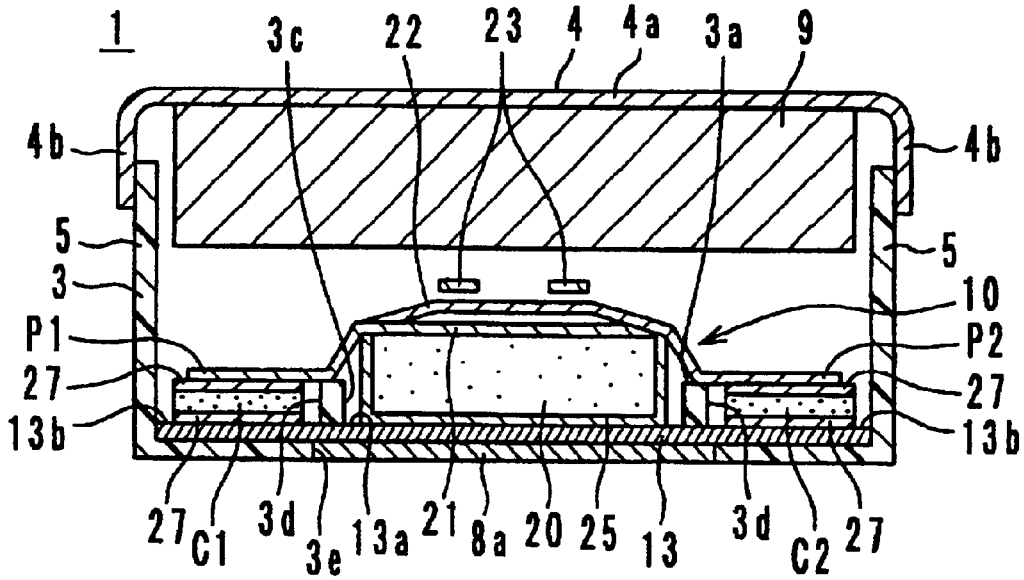
FIG. 3 is a sectional view taken on line III—III of FIG. 2.
Figure 4:
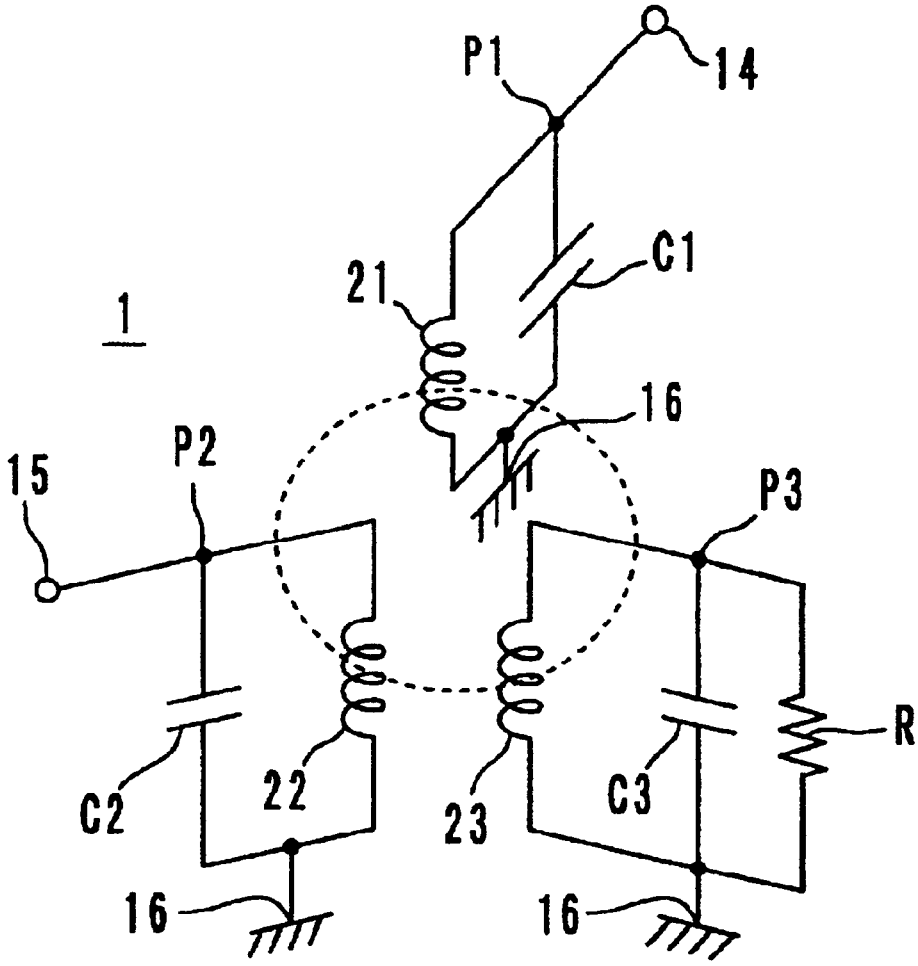
FIG. 4 is an electronic equivalent circuit diagram of the non-reciprocal circuit device shown in FIG. 2.

In this way, an isolator 1 shown in FIG. 2 is obtained. FIG. 3 is a sectional view taken on line III—III of the isolator shown in FIG. 2, and FIG. 4 is an electrical equivalent circuit diagram of the isolator 1 shown in FIG. 2.

Figure 6:
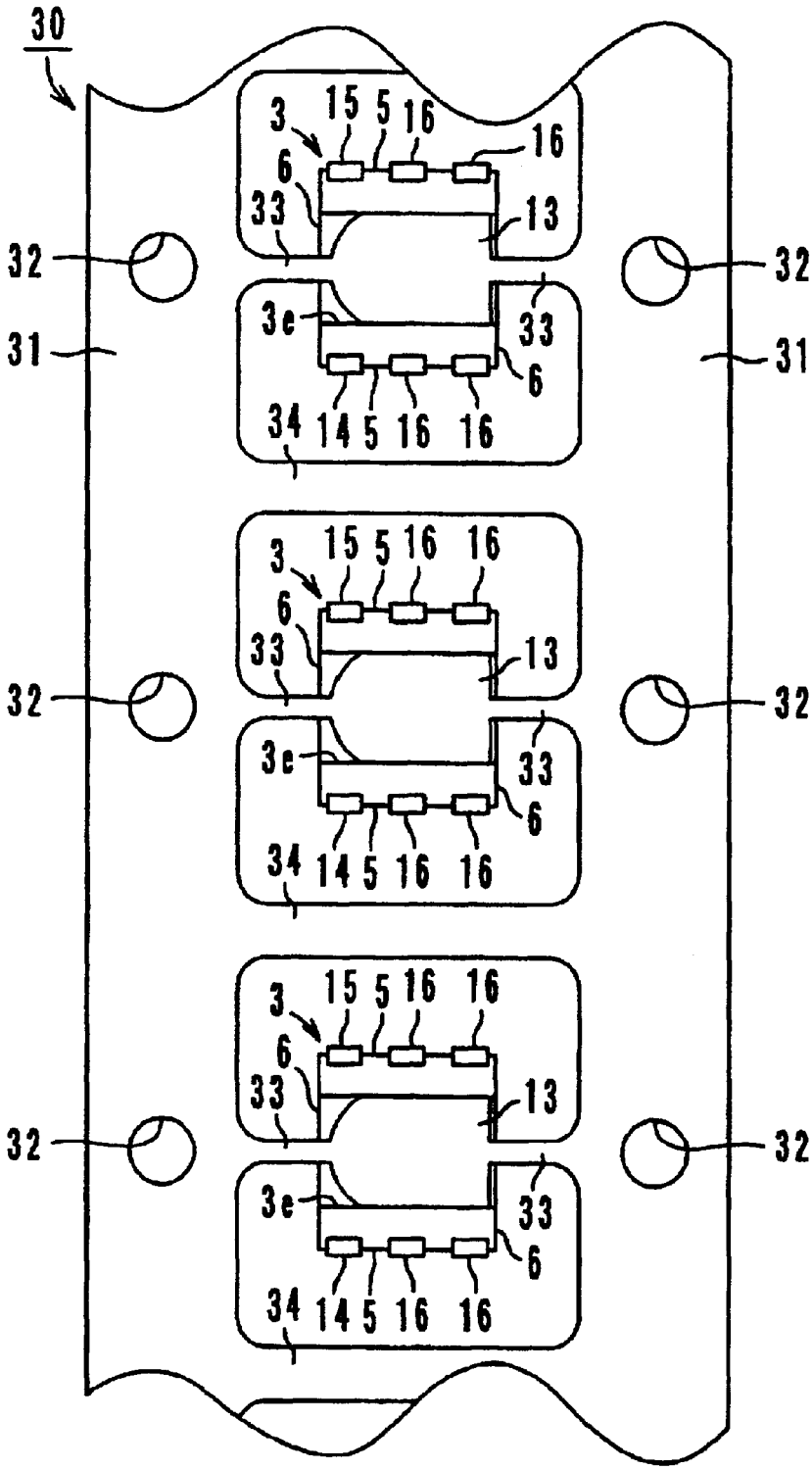
FIG. 6 is a rear view of the terminal resin case shown in FIG. 5.

The isolator 1 having the above-described configuration is manufactured using a long lead frame 30 such that handling of the isolator 1 is facilitated in manufacture and in automation of the manufacture (see FIGS. 5 and 6). The lead frame 30 is made of a base material, which is a magnetic metal having iron as a major component, and the base material is first covered with copper as a foundation to prevent corrosion and to improve anchorage of the plating on the surface, and then covered with silver having outstanding solderability.

In a pair of long hoop portions 31 of the lead frame 30, pilot holes 32 are provided at established intervals, respectively. The grounding electrode plate 13 (surface-mounting grounding terminals 16 and grounding electrodes 13*a* and 13*b*) of the isolator 1 is integrally provided at the tip of support portions 33 extending inward from each of the pair of hoop portions 31. Furthermore, a plurality of bridges 34 are provided at regular intervals between the pair of hoop portions 31. This lead frame 30 is configured such that a base material is stamped and, after bending has been performed, copper and silver plating is provided thereon.

The lead frame 30 is successively transported from one assembling process step to another via the pilot holes 32. First, after the lead frame 30 has been set in a resin molding die, the terminal resin cases 3 are formed as shown in FIGS. 5 and 6 by resin injection molding. At this time, the grounding electrode plate 13 and the surface-mounting input-output terminals 14 and 15 are integrally insert-molded into the terminal resin case 3 to obtain the terminal resin case 3 integrated with the support portions 33.

Figure 7:
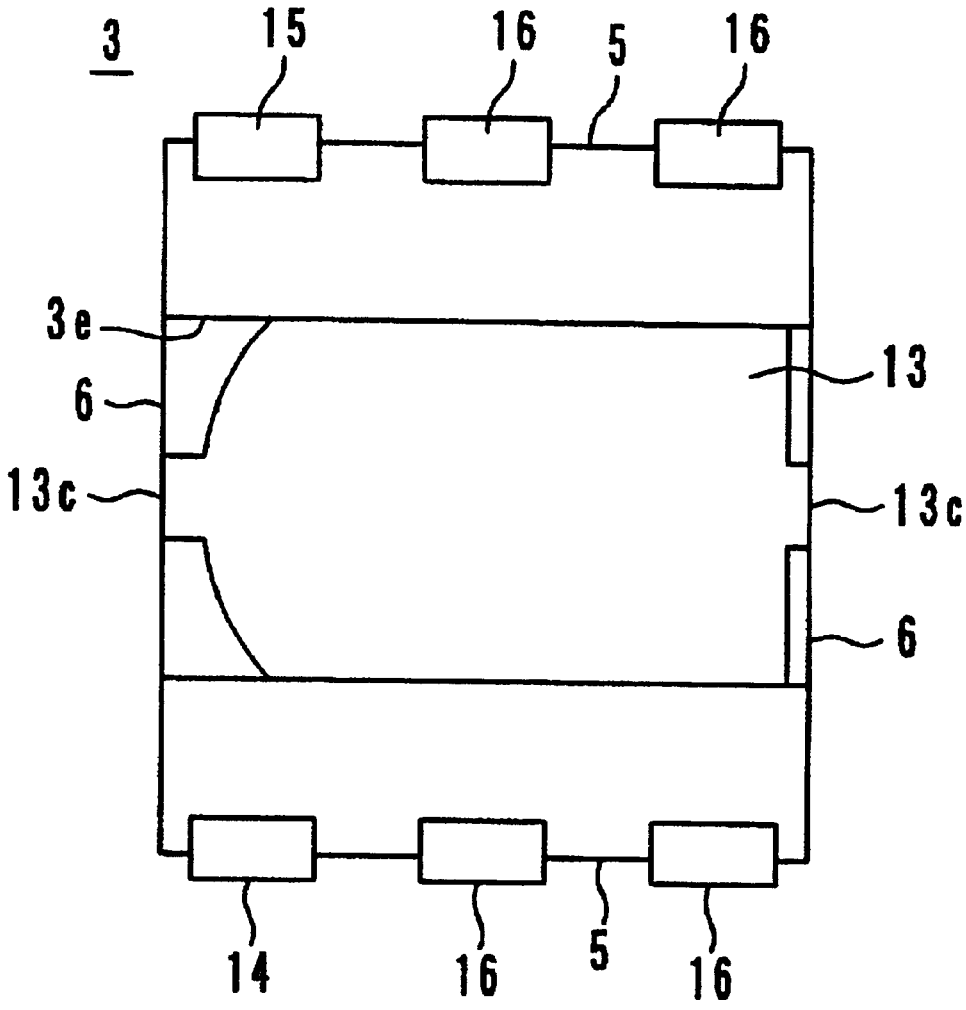
FIG. 7 is a rear view showing the state where the terminal resin case shown in FIG. 6 is separated from the lead frame.

Then, the central-electrode assembly 10, the resistance element R, the matching capacitance elements C1 to C3, and the permanent magnet 9 are provided in the terminal resin case 3, the upper metal case 4 is mounted from above, and the isolator 1 connected to the lead frame 30 is assembled. The isolator 1 connected to the lead frame 30 is separated from the lead frame 30 by stamping the pair of support portions 33 using a cutting die. At this time, as shown in FIGS. 1 and 7, the cut surface 13*c* separated from the support portion 33 is exposed on the outside surface (first side surface) of the sidewall 6 of the terminal resin case 3. The cut surface 13*c* is provided so as to be flush with the outside surface (first side surface) of the sidewall 6. The lower metal case 8 is mounted on the isolator 1 separated from the lead frame 30 from below to cover the cut surface 13*c* and to be joined to the upper metal case 4.

In the above-described isolator 1, since the cut surface 13*c* is provided on the side wall 6, which is different from the side wall 5 where the surface-mounting input terminal 14, the surface-mounting output terminal 15, and the surface-mounting grounding terminal 16 are provided, only the surface-mounting terminals 14 to 16 is provided on the side wall 5. That is, since the surface-mounting terminals 14 to 16 are disposed on the surface of the side wall 5, the size of the terminals 14 to 16 is increased and a sufficient mounting surface of each of the terminals 14 to 16 is obtained. Accordingly, the isolator 1 does not separate from the mounting board.

Figure 12:
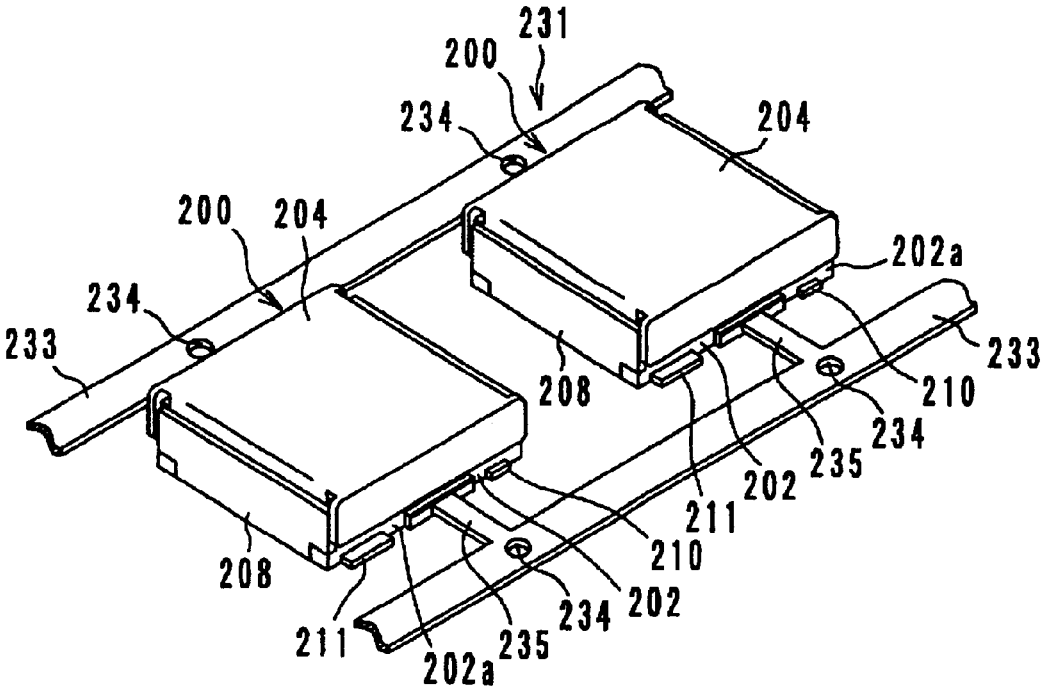
FIG.12 PRIOR ART
FIG. 12 is a perspective view of a related non-reciprocal circuit device.

Furthermore, since the cut surface 13*c* that is formed when the lead frame 30 is separated is disposed on the side wall 6 of the terminal resin case 3 and the terminals 14 to are disposed on the side wall 5 of the terminal resin case 3, only the terminals 14 to 16 are provided on the sidewall 5 and additional space for providing the connection portion 235 of the related isolator 200 (see FIG. 12) is unnecessary, the surface area of the sidewall 5 is reduced while the size of the terminals 14 to 16 remain unchanged, and accordingly the size of the isolator 1 is greatly reduced.

Furthermore, even if burrs and metal chippings exist on the cut surface 13*c*, since the cut surface 13*c* is covered by the side wall 8*b* of the lower metal case 8, short circuits and open circuits are prevented.

Figure 8:
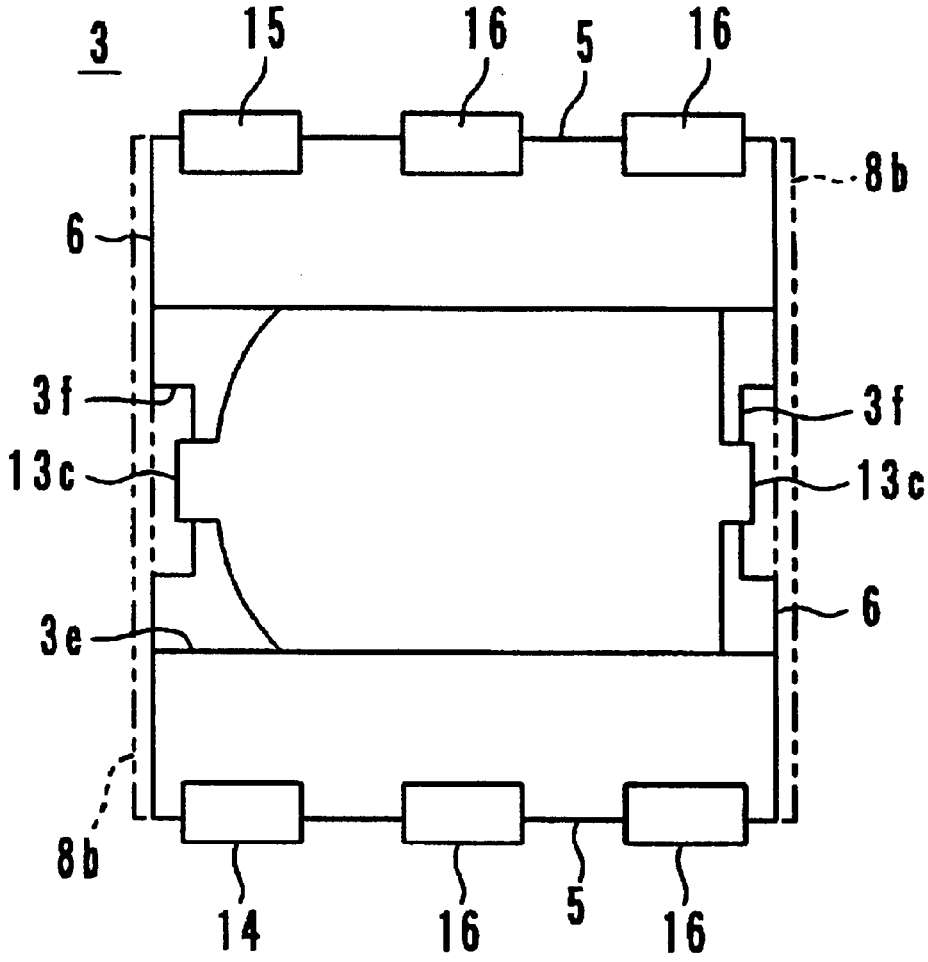
FIG. 8 is a rear view showing a modification of the terminal resin case shown in FIG. 7.

Moreover, the above-described isolator 1 can be modified, and, for example, the terminal resin case 3 shown in FIG. 7 may be configured as illustrated in FIG. 8 including concave portions 3*f* provided in the approximate middle of the opposing side walls 6 and the cut surfaces 13*c* of the grounding electrode plate 13 are provided in the concave portions 3*f*. In this case, since the cut surfaces 13*c* are disposed on the inner side of the side wall 6 of the terminal resin case 3 and the cut surfaces 13*c* are covered by the side walls 8*b* of the lower metal case 8, when the isolator 1 is separated from the lead frame 30, it is not required to increase the positional accuracy of their separation and the production cost of the isolator 1 are greatly reduced.

Figure 9:
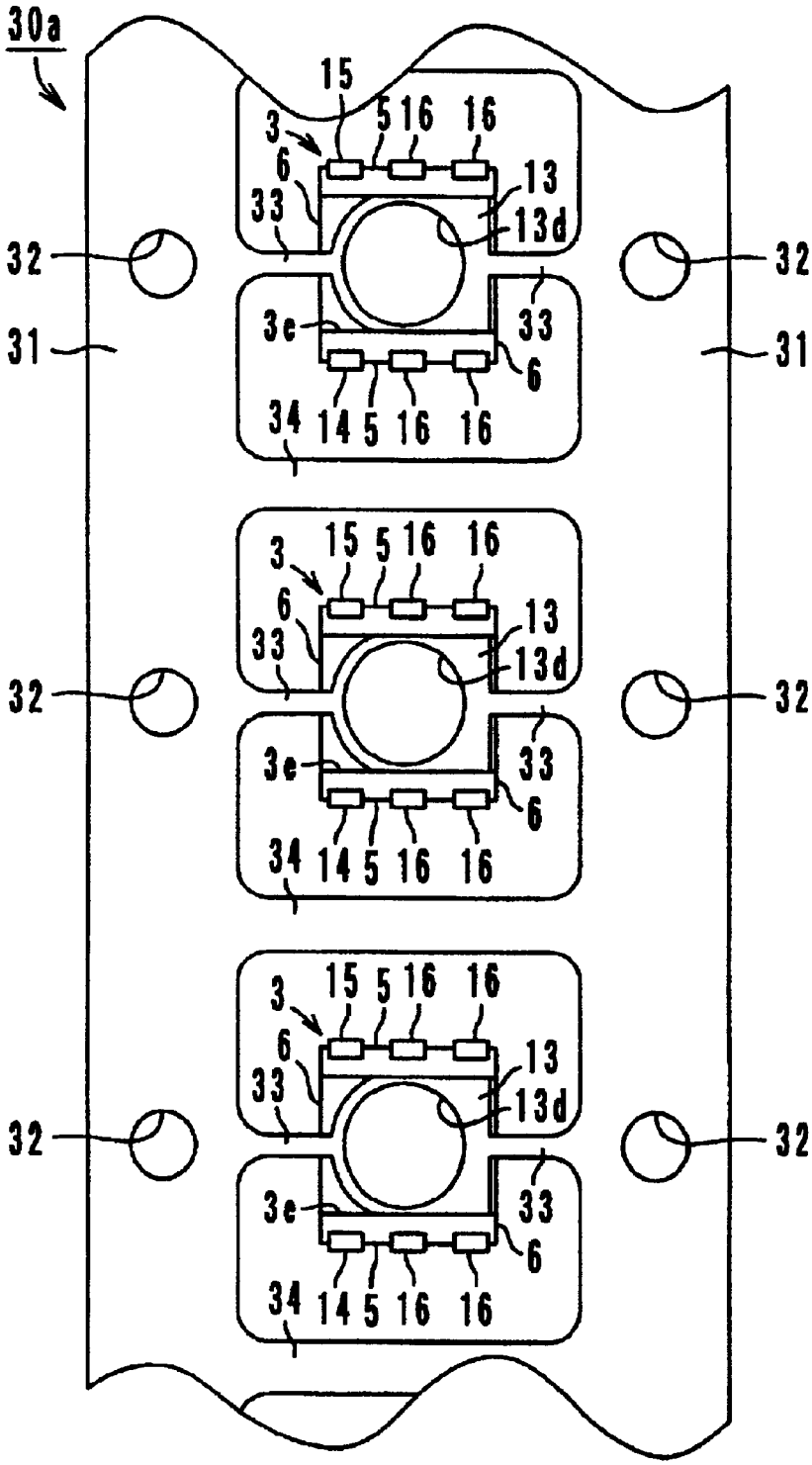
FIG. 9 is a rear view showing the state where the grounding electrode plate is insert-molded into the terminal resin case, which is to describe a manufacturing method of a terminal resin case of a second preferred embodiment of a non-reciprocal circuit device according to the present invention.

In a present second preferred embodiment, as shown in FIG. 9, an insertion hole 13*d* is also provided in the approximate middle of the grounding electrode 13*a* of the grounding electrode plate 13 shown in the first preferred embodiment of the present invention. FIG. 9 is a bottom view of the terminal resin case 3 provided in the lead frame 30*a*, and FIG. 10 is a vertical sectional view of the isolator 2 after it has been assembled.

The grounding electrode plate 13 is not divided by the insertion hole 13*d*, and, when compared with the first preferred embodiment, the ground potential is not substantially increased.

Figure 10:
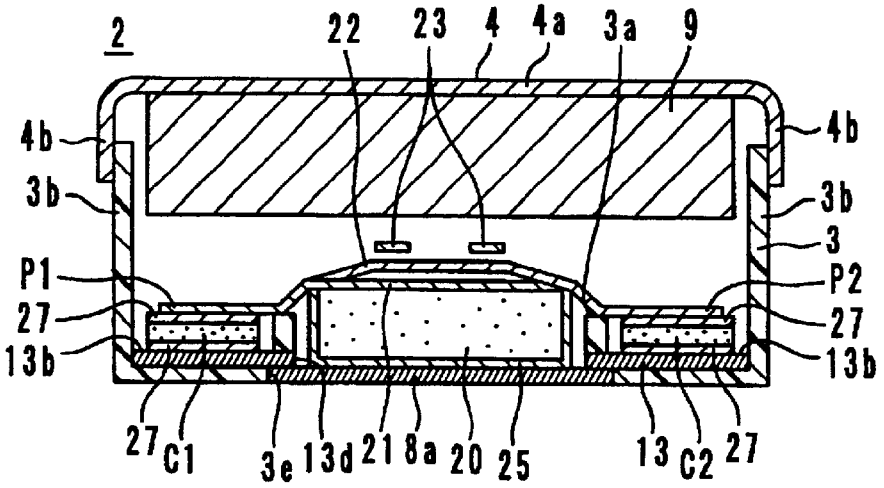
FIG. 10 is a vertical sectional view of a non-reciprocal circuit device including the terminal resin case shown in FIG. 9.

As shown in FIG. 10, the central-electrode assembly 10 is inserted in the insertion hole 13*d* provided in the grounding electrode plate 13, and the grounding electrode 25 of the central-electrode assembly 10 is electrically connected directly to the bottom wall 8*a* of the lower metal case 8. Further, the lower metal case 8 and the grounding electrode plate 13 are electrically connected. Moreover, since the central-electrode assembly 10 is inserted in the insertion hole 3*c* and the insertion hole 13*d*, the thickness of the central-electrode assembly 10 mounted in the isolator 2 (that is, substantially equal to the thickness of the ferrite 20) is greater than the total of the thickness of the insertion hole 3*c* and the thickness of the insertion hole 13*d*. When the upper surface of the ferrite 20 slightly protrudes from the bottom wall 3*a* of the terminal resin case 3, it is easier to pull out the port portions P1 to P3 from the central-electrode assembly 10.

The isolator 2 having the above-described configuration has the same advantages as the isolator 1 of the first preferred embodiment. Furthermore, since the central-electrode assembly 10 is inserted in the insertion hole 13*d* of the grounding electrode plate 13, the height of the isolator 2 is reduced by the thickness of the grounding electrode plate 13.

A third preferred embodiment is described with reference to a cellular phone as an example of a communication apparatus according to the present invention.

Figure 11:
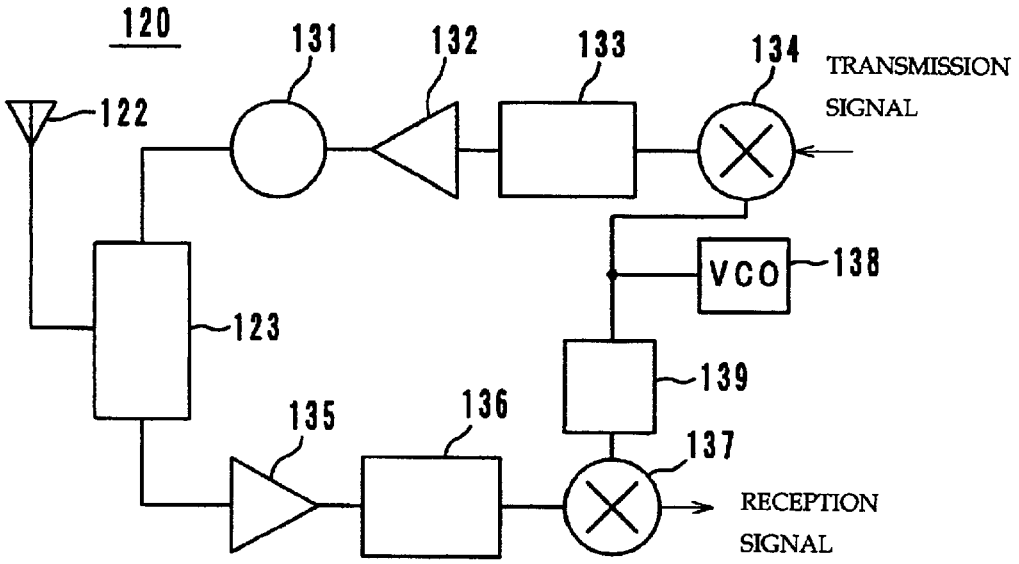
FIG. 11 is an electrical circuit block diagram showing another preferred embodiment of a communication apparatus according to the present invention.

FIG. 11 is an electrical circuit block diagram of the RF portion of a portable telephone 120. In FIG. 11, an antenna element 122, a duplexer 123, a transmission-side isolator 131, a transmission-side amplifier 132, a transmission-side bandpass filter 133 between stages, a transmission-side mixer 134, a reception-side amplifier 135, reception-side bandpass filter 136 between stages, a reception-side mixer 137, a voltage-controlled oscillator (VCO) 138, and a local bandpass filter 139 are shown.

Here, one of the lumped-constant-type isolators 1 and 2 of the first and second preferred embodiments is provided as the transmission-side isolator 131. A highly reliable portable telephone having a greatly reduced size is obtained by providing one of the isolators 1 and 2.

The present invention is not limited to the above-described preferred embodiments, and various constructions can be provided within the scope of the present invention. For example, the central electrodes 21 to 23 cross one another at an angle of about 120 degrees, but they may cross one another at an angle in the range of about 110 degrees to about 140 degrees. Moreover, although the metal case is defined by the upper metal case 4 and the lower metal case 8, it may be divided into three or more portions. Furthermore, the ferrite 20 is not limited to a disc-like shape, and another shape, such as a substantially rectangular shape or a substantially hexagonal shape, may be used. Furthermore, the shape of the permanent magnet 9 may be, for example, a substantially rectangular shape or a substantially triangular shape having round corners, in addition to a round shape. Furthermore, except that the central electrodes 21 to 23 are provided such that a metal plate is stamped out and bending is performed thereon, they may be formed such that, after a metal plate has been etched, bending is performed, and they also may be formed such that pattern electrodes are provided on a substrate (dielectric substrate, magnetic substrate, laminated substrate, etc.).

Furthermore, the present invention is appropriate for non-reciprocal circuit devices having a number of terminals such as isolators including a built-in coupler because the number of terminals can be easily increased.

As clearly understood in the above description, according to preferred embodiments of the present invention, since a cut surface formed when the lead frame is separated is disposed on the first side surface of the terminal resin case and the input-output and grounding terminals are disposed on the second side surface, different from the first side surface, of the terminal resin case, it is unnecessary to form the cut surface on the second side surface. Therefore, since only the input-output and grounding terminals are provided on the second side surface, the size of the input-output and grounding terminals is increased and simultaneously a sufficient mounting area for the input-output and grounding terminals is obtained. In addition, the size of the non-reciprocal circuit devices is greatly reduced.

Furthermore, a concave portion is provided on the first side surface of the terminal resin case, the cut surface is disposed in the concave portion, and the cut surface is covered by the metal case. Accordingly, when a non-reciprocal circuit device is separated from the lead frame, it is unnecessary to improve the positional accuracy for separation, and thus, the production cost of the non-reciprocal circuit device is greatly reduced.

Furthermore, since an insertion hole is provided through which the central-electrode assembly is inserted in the grounding electrode plate, a portion of the central-electrode assembly is provided in the grounding electrode plate. Accordingly, the height of the non-reciprocal circuit device is reduces by the thickness of the grounding electrode plate.

Furthermore, since a communication apparatus according to the third preferred embodiment of the present invention is provided with a non-reciprocal circuit device having the above-described configuration, a smaller, less expensive and more reliable apparatus is provided.

While preferred embodiments of the invention have been described above, it is to be understood that variations and modifications will be apparent to those skilled in the art without departing the scope and spirit of the invention. The scope of the invention, therefore, is to be determined solely by the following claims.

What is claimed is:

1. A non-reciprocal circuit device comprising:

a permanent magnet;

a ferrite member provided with a DC magnetic field by the permanent magnet and a central electrode assembly having a plurality of central electrodes disposed around the ferrite member;

a terminal resin case including the center electrode assembly, the terminal resin case including:

a first side surface defining a cutting surface that is formed when the terminal resin case is separated from a lead;

input-output and grounding terminals which are led out from a second side surface, different from the first side surface of the terminal resin case; and a metal case including the permanent magnet and the terminal resin case.

2. A non-reciprocal circuit device as claimed in claim 1, wherein a grounding electrode plate, separated from the lead frame at the cutting surface, is integrally provided together with the terminal resin case and the grounding electrode plate extends to define the grounding terminal.

3. A non-reciprocal circuit device as claimed in claim 1, wherein a concave portion is provided on the first side surface of the terminal resin case, the cutting surface is disposed inside the concave portion, and the cutting surface is covered by the metal case.

4. A non-reciprocal circuit device as claimed in claim 2, wherein an insertion hole for inserting the central-electrode assembly is provided in the grounding electrode plate.

5. A non-reciprocal circuit device as claimed in claim 1, further including a resistance element.

6. A non-reciprocal circuit device as claimed in claim 1, further including matching capacitance elements.

7. A non-reciprocal circuit device as claimed in claim 1, wherein the metal case includes an upper metal case and a lower metal case.

8. A non-reciprocal circuit device as claimed in claim 7, wherein said upper metal case and said lower metal case are made of a thin metal plate including iron as a major component and copper and silver plating.

9. A non-reciprocal circuit device as claimed in claim 1, wherein said ferrite member is a disk-like microwave ferrite member.

10. A non-reciprocal circuit device as claimed in claim 1, wherein said central electrode assembly includes a plurality of central electrodes that cross one another at an angle of approximately 120 degrees.

11. A non-reciprocal circuit device as claimed in claim 10, wherein each of said plurality of central electrodes includes a port portion disposed at one end thereof, and a common ground electrode provided at the other end thereof.

12. A non-reciprocal circuit device as claimed in claim 11, wherein said common ground electrode is provided so as to cover substantially an entire lower surface of the ferrite member.

13. A non-reciprocal circuit device as claimed in claim 7, wherein said terminal resin case includes a notch portion into which a bottom wall of said lower metal case is disposed.

14. A non-reciprocal circuit device as claimed in claim 1, wherein said terminal resin case is made of a material selected from the group consisting of liquid crystal polymer, polyphenylene sulfide, and polyether ether ketone.

15. A non-reciprocal circuit device as claimed in claim 1, wherein the input-output and grounding terminals are made of a base material including a magnetic metal containing iron, brass and phosphor bronze as a major component, and a metal film covering the base metal and having outstanding solderability.

16. A communication apparatus comprising a non-reciprocal circuit device as claimed in claim 1.

* * * * *